United States Patent [19]

Haagensen et al.

[11] Patent Number: 4,714,812

[45] Date of Patent: Dec. 22, 1987

[54] APPARATUS AND METHOD FOR PROCESSING DIELECTRIC MATERIALS WITH MICROWAVE ENERGY

[75] Inventors: Duane B. Haagensen, Edina; Darcy C. Moses, Rush City; Leonard S. Smith, Minneapolis, all of Minn.

[73] Assignee: John F. Woodhead, III, Deep Haven, Minn.

[21] Appl. No.: 731,981

[22] Filed: May 8, 1985

[51] Int. Cl.[4] ..... H05B 6/70

[52] U.S. Cl. ..... 219/10.55 A; 219/10.55 B; 219/10.55 F; 34/1; 333/232

[58] Field of Search ..... 219/10.55 A, 10.55 R, 219/10.55 B, 10.55 E, 10.55 F, 10.55 M; 34/1, 4; 333/231, 232, 233, 224, 225, 226

[56] References Cited

U.S. PATENT DOCUMENTS

| | | | |
|---|---|---|---|
| 2,630,475 | 3/1953 | Woodward, Jr. . | |
| 3,261,959 | 7/1966 | Connell et al. | 219/10.55 A |
| 3,461,401 | 8/1969 | Williams | 219/10.55 B X |
| 3,590,202 | 6/1971 | Day et al. | 219/10.55 |
| 3,597,566 | 8/1971 | Johnson et al. | 219/10.55 |
| 3,611,582 | 10/1971 | Hamid et al. | 219/10.55 |
| 3,775,860 | 12/1973 | Barnes et al. | 34/1 |
| 3,783,221 | 1/1974 | Soulier | 219/10.55 A |
| 4,004,122 | 1/1977 | Hallier | 219/10.55 A |
| 4,015,341 | 4/1977 | McKinney et al. | 34/4 |
| 4,045,639 | 8/1977 | Meisel | 219/10.55 A |
| 4,099,042 | 7/1978 | Jean et al. | 219/10.55 A |
| 4,129,768 | 12/1978 | Anderson | 219/10.55 A |
| 4,179,595 | 12/1979 | Chiron | 219/10.55 F |
| 4,196,332 | 4/1980 | MacKayb et al. | 219/10.55 R X |
| 4,207,452 | 6/1980 | Arai | 219/10.55 A |
| 4,210,795 | 7/1980 | Lentz | 219/10.55 B |
| 4,222,176 | 9/1980 | Tjurin et al. | 34/1 |
| 4,263,653 | 4/1981 | Mecklenburg | 34/58 B |
| 4,314,128 | 2/1982 | Chitre | 219/10.55 B |
| 4,330,946 | 5/1982 | Courneya | 34/1 |
| 4,334,136 | 6/1982 | Mahon et al. | 219/10.55 R X |
| 4,348,572 | 9/1982 | Moule | 219/10.55 A |

*Primary Examiner*—Philip H. Leung

*Attorney, Agent, or Firm*—Peterson, Wicks, Nemer & Kamrath

[57] ABSTRACT

The microwave apparatus for processing dielectric materials includes a number of tunable cavity devices arranged vertically one above the other, each having a movable piston. Dielectric conduit means extend downwardly through all of the cavity devices, passing through the various movable pistons. Each tunable cavity device has a microwave generator associated therewith so as to supply controlled amounts of power at frequencies depending upon the type of material being processed. The processing is monitored by additional cavity devices, each having a movable piston. Whereas the pistons of the power cavity devices are positioned so as to cause the material being processed to absorb a maximum amount of microwave power, the pistons in the monitoring devices are positioned so that a detectable amount of power is reflected. The amount of reflected power is indicative of an electrical characteristic, such as moisture. A signal is derived from each of the monitoring devices for controlling the amount of power to the power cavity device with which it is associated. Graphs are employed so that the optimum position for a given plunger can be selected for the greatest amount of absorption (or the least amount of reflection) to be attained and in order to determine the amount of microwave power to be supplied to a particular power cavity device.

43 Claims, 7 Drawing Figures

APPARATUS AND METHOD FOR PROCESSING DIELECTRIC MATERIALS WITH MICROWAVE ENERGY

BACKGROUND OF THE INVENTION

1. Field of the Invention

This invention relates generally to the processing of dielectric materials utilizing microwave energy to do so, and pertains more particularly to a system and method utilizing concentrated microwave power for heating, drying, curing and/or deinfesting a wide variety of such materials.

2. Description of the Prior Art

The patent literature is replete with various systems and processes making use of high frequency power to achieve specific goals or results. For the most part, such prior art arrangements are designed to perform a specific task on a particular product. In general, such previous techniques have been quite costly, and in a number of instances have been comparatively inefficient.

As indicated above, a number of patents exist in which various attempts have been made to derive a specific result when using high frequency energy. For example, there is U.S. Pat. No. 3,611,582, issued on Oct. 12, 1971 to Michael A. Hamid et al for "Microwave Package for Control of Moisture Content and Insect Infestations of Grain." In the system described in this patent, a magnetron is employed as the microwave generator for directing microwave energy into a column of grain flowing downwardly through a waveguide. A flap valve at the lower end of the column controls the rate of descent of the grain. In one embodiment, a window pervious to microwave energy permits the microwave energy to be literally sprayed onto the downwardly flowing column of grain. In another embodiment, two such windows are utilized so as to introduce the microwave energy at two vertically spaced locations. Temperatures are sensed of the flowing grain and the flap valve at the bottom of the column of grain is adjusted so as to control the temperature by regulating the flow of grain. While the system is apparently more efficient than a number of patented arrangements, nonetheless, the use of a waveguide does not result in a high degree of absorption of the microwave energy. Also, the degree of control derived from the flap valve is only of a general character and is not as precise as would be required in the processing of many dielectric materials.

Even though a number of patents claim a high degree of efficiency, it should be borne in mind that the degree of efficiency is only relative. A rather complicated and costly apparatus is described in U.S. Pat. No. 4,330,946, granted on May 25, 1982 to Calice G. Courneya for "High Efficiency Material Drying." In the apparatus described in this patent, the efficiency is increased by reclaiming some of the heat that would otherwise be lost in the moisture that is removed. The efficiency is also enhanced by utilizing a vacuum drying chamber in which a bank of magnetrons is associated, some of the heat being reclaimed from the magnetrons and from the vapor containing the moisture that has been removed from the granular material. The microwave energy is literally sprayed toward the granular material as it is augered through what is termed in the patent as a primary chamber. While the patented apparatus is perhaps more efficient than some of the earlier processes, and the patentee stresses this, nevertheless, the patented apparatus is quite costly to manufacture, as explained above, and actually requires a significant amount of electrical energy to reclaim the heat, the reclaiming procedure being a principal objective of the patentee.

SUMMARY OF THE INVENTION

Accordingly, an important object of the present invention is to achieve an absorption efficiency not heretofore realized when utilizing microwave energy. More specifically, an aim of my invention is to derive a high degree of efficiency by utilizing a series or plurality of tandemly arranged cavity devices in contradistinction to previously used waveguides, either when employed alone or in combination with a vacuum chamber. Provision is made for assuring that the cavity, actually each of a number of cavities, is tuned to a high Q so as to achieve the absorption efficiency that is superior to other known prior art arrangements.

Not only is the above object realized, it is achieved in an inexpensive and low cost manner. In this regard, the apparatus exemplifying the present invention can be fabricated at a comparatively low cost, thereby encouraging its widespread use, together with the method associated therewith.

Another object of the invention is to provide an apparatus and method utilizing microwave energy for processing dielectric material in which the materials are processed rapidly. More specifically, an aim of the invention is to provide apparatus that will process continually flowing materials. Stated somewhat differently, the materials are handled in an "on-line" fashion.

Another object is to employ a series of tuned cavity devices in a modular-like manner, thereby further increasing the efficiency and effectiveness of the invention. Actual tests have indicated that efficiencies on the order of 99 percent are readily obtainable when practicing the invention.

An additional object of the invention is to avoid the use of any vacuum equipment which has heretofore increased the cost of such apparatus. The instant invention enables the efficient processing of various dielectric materials under only atmospheric pressure.

Still further, an object is to provide a system of the foregoing character which is exceedingly versatile and flexible in that it is not limited to the processing of any particular dielectric product. Not only can a variety of materials be processed, the type of processing can be changed to best suit the particular material being processed. In this regard, it is contemplated that at times various states of drying will be required, at other times the material will have to be heated to precise temperatures, at other times deinfestation is required, and occasionally it is desirable that the particular material be properly cured. The herein described system permits the amount of microwave power to be adjusted, the frequency to be changed, and the cavity size to be altered, all depending upon the particular end result that is expected for a given type of product. For instance, in the processing of granular products, particularly seed, it is important that the seed not be overheated, for this would adversely affect the germination rate, the failure of planted seeds to germinate being indeed costly to the farmer.

The invention additionally has as an object the precise control of microwave-generated heat so as to prevent overheating or overdrying of various materials, either of which is wasteful. While the invention involves a sophisticated monitoring system, it can be pointed out that the processing of relatively small and uniform amounts of a material in a continually flowing stream paves the way for achieving a precise end result. If the end result is drying, then control is such as not to overdry the flowing material. By employing a number of sequentially arranged microwave cavity devices, each device can be individually controlled in a specific manner. For example, should the first cavity device be responsible for effecting a substantial amount of drying, then the next device can be assigned the task of effecting a lesser amount of drying. Stated somewhat differently, the first cavity device can be supplied with a greater amount of power, and the second device with a lesser amount of power. It is also within the scope of the invention to vary the frequency of the power being supplied to a particular cavity device, all depending upon the specific processing step that is to be performed as the material flows through that particular cavity device when such a device is but one of a chain of such devices.

With regard to the versatility of the invention, it should be pointed out that it is of benefit to arrange a number of cavity devices in a tandem relationship with each other so that not only can the heat and frequency be varied with respect to each device, but a supplemental processing step can be initiated in advance or following each individual cavity device of the series. In this regard, a drying step can be performed with, say, the first cavity device, and then nutrients can be added to the flowing material prior to the material entering the next cavity device. A third cavity device, for example, can have a coating material introduced in advance thereof so that the end product, after going through several stages, will be of a compositely desired character.

An important object of the invention is to be able to monitor the product being treated, doing so at various stages during the product's advancement through the apparatus. Whereas a series of microwave cavities are instrumental in heating the flowing material to predetermined temperatures, the invention envisions the use of still additional microwave cavities for determining a sought after electrical characteristic that would be indicative of the condition of the product at any given point in the processing system. More specifically, it is planned that various cavity devices be tuned so as to virtually eliminate any reflections, thereby increasing the degree of absorption of microwave energy by the material flowing therethrough, and similar cavity devices be untuned to such an extent so as to produce a significant level of reflective power with the consequence that the amount of reflective power will be indicative of the electrical characteristic of the material at that particular point and hence representative of, say, the degree of moisture or, say, the temperature thereof.

In general, the herein disclosed apparatus and method provide a simple system for selectively processing a number of diverse dielectric products, doing so with a precise degree of control of the microwave energy for any given product. It is important to appreciate that the various cavity devices can be adjusted so as to accomodate the particular type of material passing therethrough and to alter the characteristics thereof in a predetermined manner not heretofore possible with existing microwave equipment.

Briefly, the invention includes a series of vertically stacked microwave devices and a dielectric conduit comprised of individual plastic tubes extending downwardly through each of the devices. The cavity devices are supplied with microwave energy through the agency of individually controlled microwave generators. While certain of the microwave cavity devices are intended to couple an appreciable amount of microwave power into the flowing material so that it will be processed to the extent desired, it is planned that additional microwave cavity devices be employed for monitoring the condition of the material after it has passed through each of the various power devices.

It is also within the purview of the invention to utilize a servocontrol so as to utilize the information sensed by a given monitoring cavity device, effecting an adjustment of the power being supplied by the particular microwave generator in accordance with the sensed information. In this way, if additional heat is needed at any stage of the processing stream, the increase in microwave energy delivered to the particular cavity device responsible for adding heat at that stage will cause an increase in temperature of the proper magnitude.

Inasmuch as the invention will find especial utility in drying various materials, it is also planned that an effective moisture removing system be incorporated into the apparatus exemplifying the invention. In this regard, a blower arrangement is employed so that the moisture can be removed, if desired, from a location or point between each power cavity device and each monitoring cavity device.

A movable plunger or piston enables each cavity device to be tuned for the particular role it is intended to perform. In this regard, each power cavity device would be tuned by way of its movable piston so as to maximize the absorptive capabilities of that particular cavity device for the material passing therethrough, whereas each monitoring cavity device would sense the reflected power representative of a particular electrical characteristic of the material at that location, namely, after the material has been subjected to concentrated microwave energy by the particular power cavity device immediately preceding said location.

DESCRIPTION OF THE PREFERRED EMBODIMENT

Figure 1:
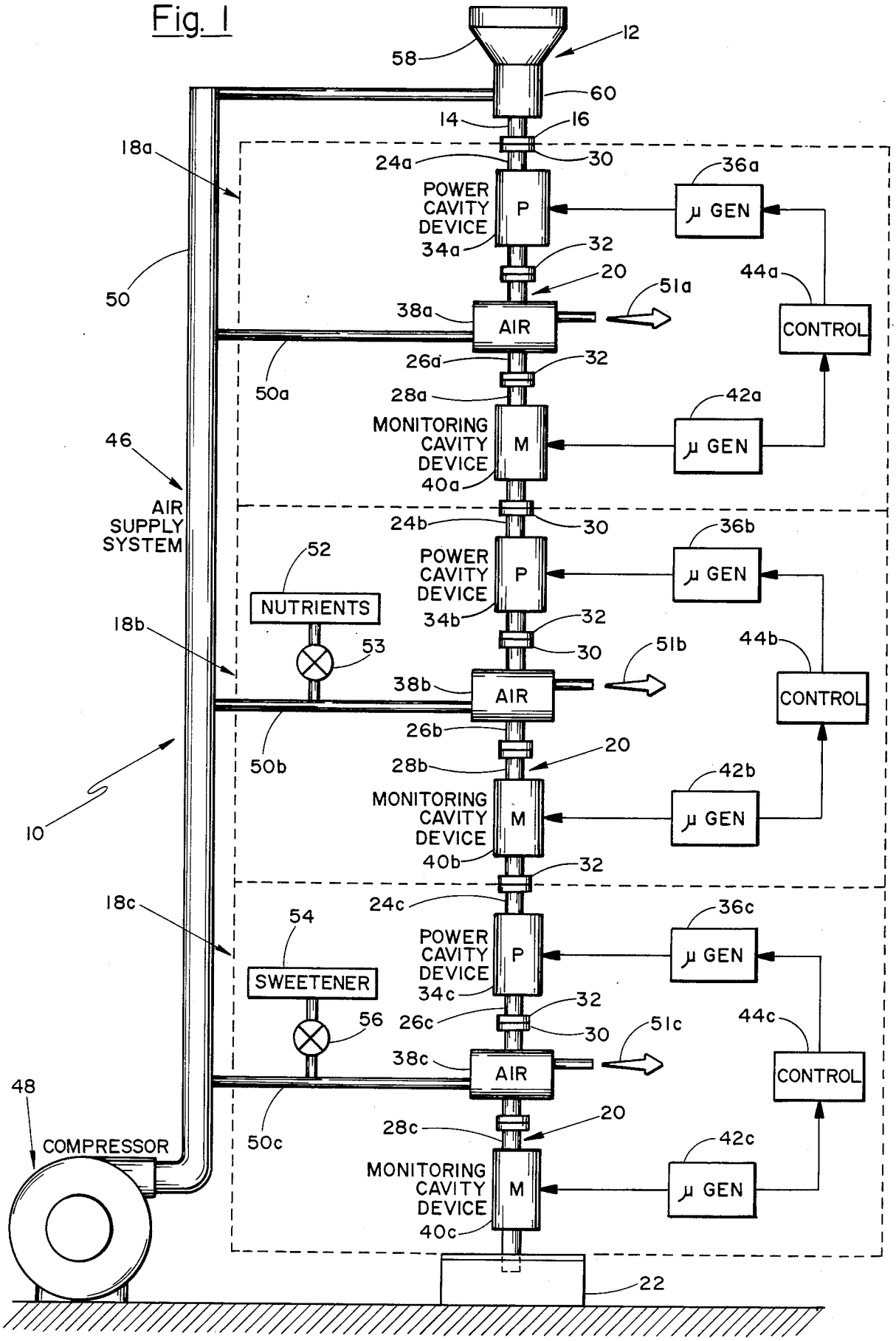
FIG. 1 is a diagrammatic view, largely in block form, illustrating one embodiment of the invention.

Referring first to FIG. 1, it will be discerned that apparatus selected to exemplify the invention has been denoted generally by the reference numeral 10. The apparatus 10 includes a material feeding mechanism 12, the lower end of which mechanism 12 discharges granular material or whatever dielectric material is to be processed at a controlled rate into the upper end of a plastic tube 14 such as Teflon, having a flange 16 at its lower end.

The dielectric material is delivered to the first of three generally similar microwave processing units or stages 18*al*, 18*b* and 18*c* which are vertically stacked in a tandem or serially arranged manner, as is evident in FIG. 1. A dielectric conduit means denoted generally by the reference numeral 20 extends downwardly through each of the microwave units or stages 18*a*, 18*b* and 18*c* so that the dielectric material will be discharged into a storage bin 22 (or delivered to packaging equipment or perhaps be further processed) beneath the lowermost microwave unit or stage 18*c*, the bin 22 thus receiving the dielectric material after it has been successively processed in the units or stages 18*a*, 18*b* and 18*c* in a manner to be described. To render the apparatus 10 modular, the conduit means 20 is comprised of a number of plastic tubular sections. In this regard the unit or stage 18*a* includes plastic tubes 24*a*, 26*a* and 28*a*, and 28*a*, each with an upper flange 30 and a lower flange 32. Similarly, the intermediate unit or stage 18*b* includes those plastic tubes 24*b*, 26*b* and 28*b*, each also having an upper flange 30 and a lower flange 32. Likewise, the lowermost unit or stage 18*c* contains three plastic tubes 24*c*, 26*c* and 28*c*, each with flanges 30 and 32. In this way, the components yet to be described can be added, removed and/or replaced in the apparatus by simply connecting and disconnecting adjacent flanges 30, 32.

The first unit or stage 18*a* includes therein a power cavity device 34*a*, a microwave generator 36*a* for supplying a relatively large amount of microwave power thereto, a vapor removing chamber 38*a*, a monitoring cavity device 40*a*, a relatively small microwave generator 42*a* for supplying a relatively small amount of microwave power thereto, and a servo or control circuit 44*a* for controlling the generator 36*a* in accordance with a signal derived from the monitoring device 40*a* which signal is indicative of an electrical characteristic of the flowing dielectric material.

The components comprising the second unit or stage 18*b* correspond structurally to those referred to above, although they may perform different functions. Therefore, the components will be distinguished by using the suffix "b" rather than the suffix "a". Likewise, the components constituting the unit or stage 18*c* have been distinguished by the suffix "c".

Common to all three of the units or stages 18*a*, 18*b* and 18*c* is an air supply system indicated generally by the reference numeral 46. Included in the air supply system is a centrifugal compressor 48 having its discharge end connected to a vertical manifold or pipe 50 which conveys air under pressure upwardly to the feeder unit 12. However, horizontal branch lines 50*a*, 50*b* and 50*c* lead from the pipe 50 to the various vapor removing chambers 38*a*, 38*b* and 38*c*, respectively. It will be helpful, it is believed, to utilize several arrows signifying the flow of moisture-laden air from each of the vapor removing chambers 38*a*, 38*b*, 38*c*. These arrows have been indicated by the reference numerals 51*a*, 51*b* and 51*c*.

The description up to this point has basically suggested a drying procedure. Whereas the air delivered to the vapor removing chambers 38*a*, 38*b* and 38*c*, on the face of the matter, would indicate that the invention's main purpose is to remove moisture from the product or material as it passes through each unit or stage 18*a*, 18*b*, 18*c* to demonstate to some extent the versatility of the apparatus 10, a nutrient supply 52 is shown in block form, having a valve 53 between it and the branch line 50*b* that delivers air to the vapor removing chamber 38*b*.

By the same token, to further illustrate the versatility of the apparatus, it is planned that some ingredient be added to the material gravitationally flowing downwardly through the apparatus 10. With this in mind, a supply of an appropriate sweetener has been labeled 54, having a valve 56 between it and the branch line 50*c*.

Figure 2:
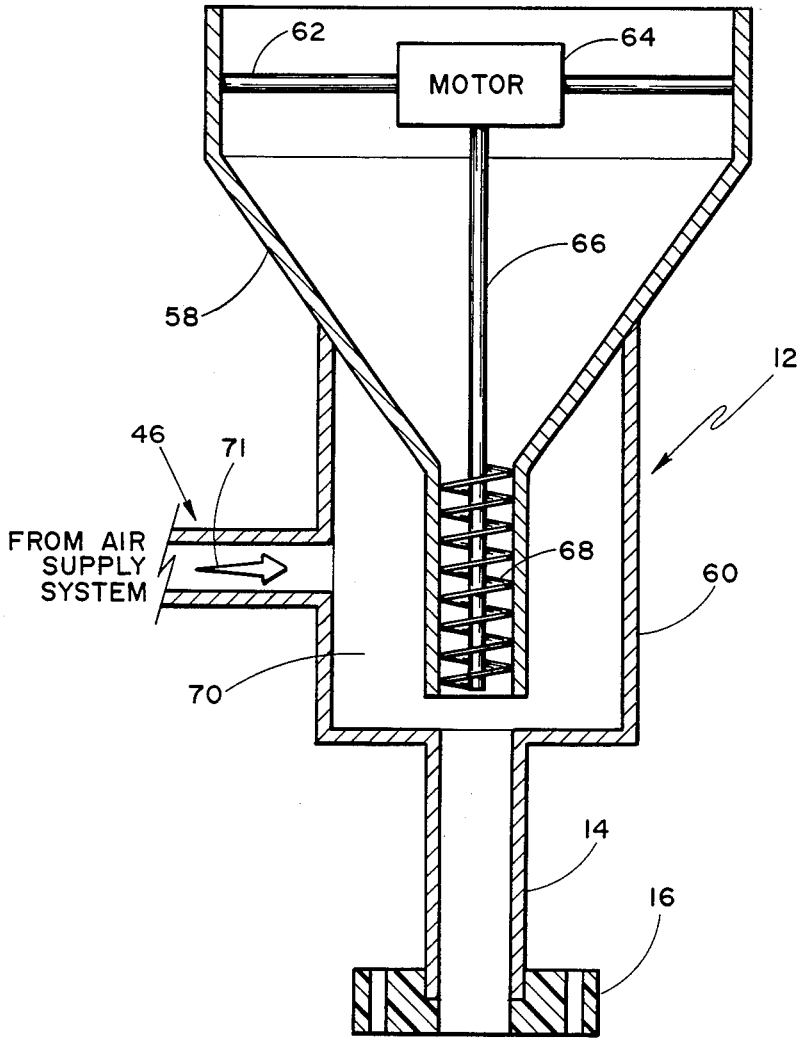
FIG. 2 is a vertical section through the upper portion of the apparatus shown in FIG. 1, the view illustrating the manner in which the dielectric material to be processed is fed into the upper end of the apparatus.

Considering now a detailed description of FIG. 2, it will be recognized that this figure pictures a representative mechanism 12 for feeding or delivering the dielectric material to be processed into the upper end of the conduit means 20. Accordingly, it will be seen from FIG. 2 that a hopper 58 is included having a discharge spout 60 at its lower end. By means of a mounting yoke 62, an electric motor 64 is held centrally within the upper portion of the hopper 58, having a shaft 66 extending downwardly thereform so that an auger 68 affixed to the lower end of the shaft 66 serves to advance the material contained in the hopper 58 downwardly at a controlled feeding rate. To assist the downward flow of the material, the uppermost end of the manifold 50 leads into a plenum indicated by the reference numeral 70. The air being delivered into the plenum 70, as indicated by the arrow 71, thus mixes with the material delivered by the auger 68.

Figure 3:
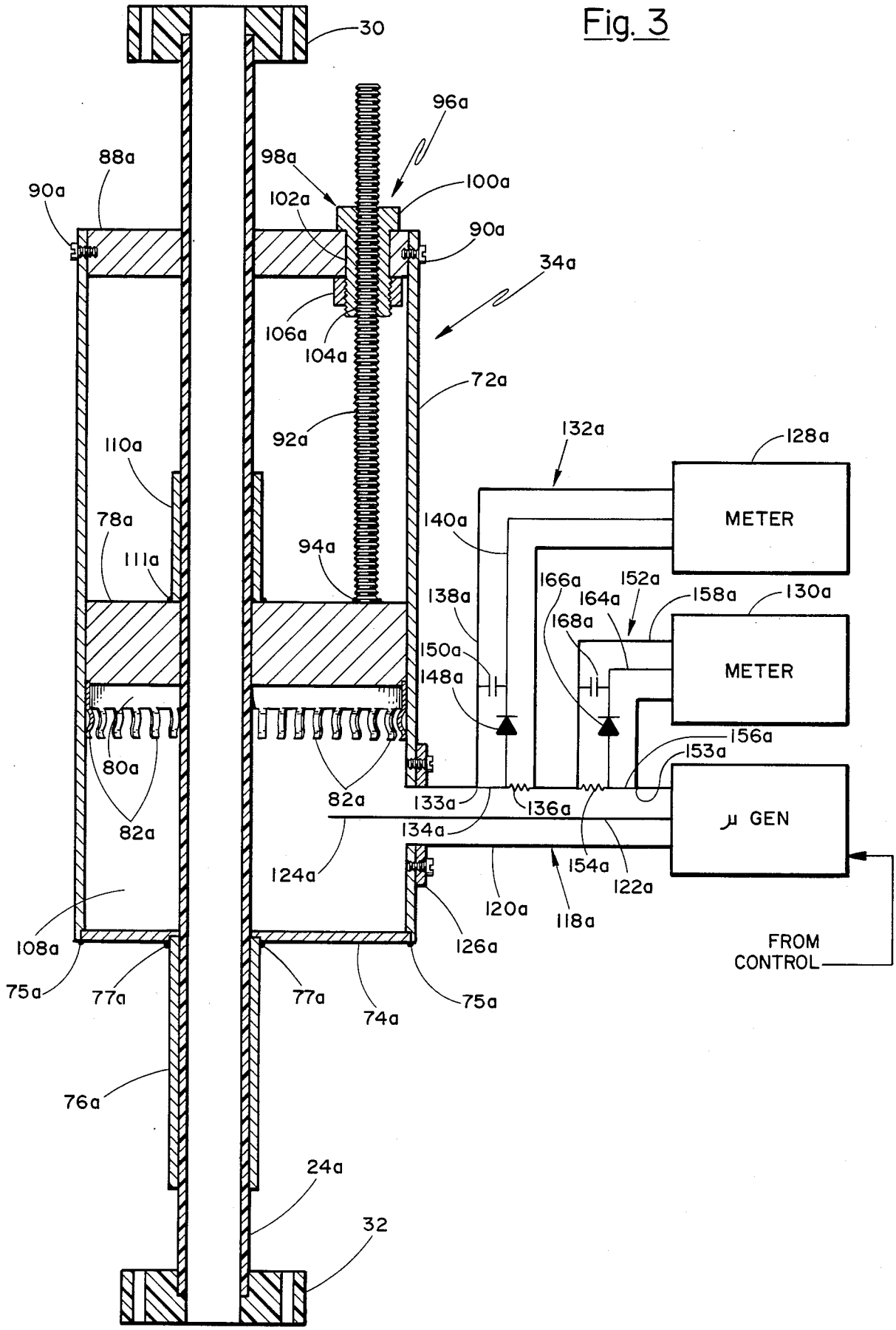
FIG. 3 is a vertical section through one of the power cavity devices, together with a microwave generator in block form that delivers a controlled amount of microwave energy to the power cavity device.

For the sake of simplicity, it will be assumed that some type of grain is to be dried and that the material, for instance, is corn. At any rate, the mixture of grain and air moves downwardly through the plastic tube 14 into the upper end of the conduit means 20 (FIGS. 1 and 3). It should be recognized, however, that while the amount of grain, that is, the rate at which it is fed into the apparatus 10 is governed by the speed at which the motor 64 rotates, once the grain leaves the spout 60 at the lower end of the hopper 58, then the downward flow thereof is governed largely by gravity, although the air entering the plenum 70 can produce a certain amount of downward acceleration. A reason for the air being delivered into the plenum 70 is to maintain as complete a separation of the grain kernels as practical, for this facilitates the drying action that is performed by means of the power cavity devices 34*a*, 34*b*, 34*c*.

While drying has been mentioned, it will be recognized that the processing steps to be performed by the cavity devices 34*a*, 34*b*, 34*c* could be to, say, puff wheat, the puffing taking place in the device 34*a* followed by additional processing steps performed by the devices 34*b* and 34*c*. As the description progresses, one will appreciate that various products can be processed. Later on, the processing of potato chips will be briefly described, for they pose special problems for present-day systems, but present virtually no problem when the apparatus 10 is employed.

Describing now the power cavity device 34*a* illustrated in FIG. 3, it will be first observed that the plastic tube 24*a* extends completely through the device 34*a*.

The cavity device 34a itself includes a metallic cylindrical shell or casing 72a which may be formed of brass pipe having a length on the order of sixteen inches and an inside diameter of five inches with a wall thickness of 0.128 inch. At the lower end of the shell or casing 72a is a fixed end wall 74a, the end wall 74a being soldered at 75a to the lower end of the casing 72a. A cylindrical choke 76a extends downwardly from the lower face of the fixed end wall 74a, the upper end of the choke 76a also being secured in place by soldering, as indicated at 77a. The choke 76a is on the order of nine inches in length, having an inside diameter of two inches. It will be appreciated that the inside diameter or choke bore is sufficient to encircle the outside diameter of the plastic tube 24a that extends completely through the cavity device 18a now being described.

Whereas the bottom wall 74a is fixed, the cavity device 34a has a movable wall in the form of a plunger or piston 78a. The piston 78a permits the cavity device 34a to be tuned to a high Q so that it causes the material passing downwardly through the plastic tube 24a to absorb a large amount of microwave energy. The piston 78a is provided at its lower end with a cylindrical metal band 80a having a plurality of spring or resilient fingers 82a extending around the lower periphery thereof, thereby forming an electrical seal in this region. In this way, the position of the movable piston 78a is determinative of the resonant condition of the cavity defined by the lower portion of the casing 72a, the lower end wall 74a and the piston 78a. The power cavity device 34a has an upper end wall 88a secured in place by a plurality of screws 90a.

The manner in which the piston 78a is positioned within the shell or casing 72a is by means of a threaded stud or rod 92a having its lower end, as viewed in FIG. 3, fixedly attached at 94a to the piston 78a, as with solder. The rod 92a extends upwardly through a spool-like adjusting unit 96a. As illustrated, the unit 96a comprises a rotatable bushing 98a having a knurled tuning knob or flange 100a at its upper end and a downwardly extending sleeve 102a. The bushing 98a has a threaded bore 104a extending therethrough, the threads of the bore 104a engaging the threads of the stud or rod 92a. The lower end of the sleeve 102a is externally threaded so that a nut 106a can be threaded thereon, the nut 106a preferably being locked in place, such as by a lock nut (not shown). In this way, the tuning knob 100a can simply be manually twisted so as to advance or retract the stud or rod 92a and thus advance or retract the piston 78a, thereby moving it downwardly or upwardly in order to effect a tuned condition of the cavity device 34a.

It is intended that the piston 78a be movable over approximately a two inch vertical distance. When in its lower position, then the cavity 108a formed between the wall 74a and piston 78a is on the order of six inches. Although the piston 78a provides some choking action a second choke 110a, which can be somewhat shorter than the choke 76a, extends upwardly from the piston 78a, being secured to the piston 78a at 111a. In this way microwave energy is for all intents and purposes confined to the cavity 108a throughout the entire movement or travel of the piston 78a.

Inasmuch as the tuning knob 100a is to be manually rotated, and the piston 78a W is concealed within the casing 72a, a suitable mechanism (not shown) may be provided for indicating the particular position of the piston 78a. As explained above, the piston 78a is movable over a two inch length of travel, or perhaps somewhat more, so the user of the apparatus 10 should be visually apprised of the position of the piston 78a within the casing 72a. Merely observing the length of the rod 92a that projects above the upper end wall 88a will in most instances be adequate as far as indicating the position of the piston 78a.

The microwave generator 36a, of course, supplies power to the cavity device 34a. It will helpful, though, to point out that this is done by means of a standard coaxial cable 118a extending between the microwave generator 36a and the power cavity device 34a. As is well-known, a coaxial cable includes an outer metallic sheath or conductor 120a and a centrally or concentrically disposed conductor 122a therein. In this instance, the tip of the concentric conductor functions as a probe 124a. In this regard, it serves as an antenna which is merely an extension of the inner conductor 122a, the outer conductor 120a being folded back so that the probe 124a constitutes a quarter-wave length extension of the inner conductor 122a. There is an antenna mounting block 126a that holds the antenna or probe 124a in a fixed relationship with the casing 72a. It will be observed, however, that the projection of the probe or antenna 124a into the cavity 108a requires that the plastic tube 24a be offset so as to permit the probe 124a to efficiently radiate microwave power into the cavity 108a without interference.

Inasmuch as it is planned that the adjusting unit 96a be manually rotated by means of the knob 100a, in order to ascertain when the cavity device 34a is properly tuned, two readout meters 128a, 130a are provided. Actually, these are just direct current ammeters. The meter 128a is connected so that it indicates the amount of forward power being supplied to the cavity device 34a, whereas the meter 130a indicates the amount of power being reflected. When power is to be absorbed by the material flowing through the plastic tube 24a, one wishes to maximize the power being delivered to the cavity device 34a. To enable the amount of forward power to be determined, an auxiliary coaxial cable 132a is connected into the sheath 120a of the main or power delivering coaxial cable 118a, an opening being formed at 133a in the sheath 120a. More specifically, an electrical short 134a, constituting a short piece of metal, is provided on the forward side, that is, the side nearer the probe 124a. In the opposite direction, a resistor 136a on the order of 50 ohms is inserted. The auxiliary cable 132a has an outer metal sheath labeled 138a and has its central conductor labeled 140a.

The conductor 140a, it will be noted, has a diode 148a in circuit therewith so as to provide a pulsating direct current signal. A capacitor 150a provides the return path for the RF energy. What should be appreciated, though, is that the amount of forward power being fed to the cavity device 33a is in this way determined, for one only has to view the meter 128a in order to see what its reading is. As already indicated, the meter 128a is simply a direct current ammeter.

Since one wishes to minimize the amount of reflected power when subjecting the passing dielectric material to microwave energy, in order to obtain an indication of the amount of power being reflected, a second auxiliary coaxial cable 152a is utilized, there being an opening at 153a in the sheath 120a. In this instance, though, a 50 ohm resistor 154a is inserted closer to the probe 124a and a short at 156a is inserted in the opposite direction. In this situation, the outer metallic sheath 158a of the cable 152a goes to the meter 130a. The central conductor 164a has a diode 166a therein plus a capacitor 168a corresponding in function to that performed by the capacitor 150a.

It will thus be appreciated that the rotation of the tuning knob 100a positions the plunger or piston 78a within the shell or casing 72a in the specific position to which it is moved in order to maximize the forward power and minimize the reflected power which values can be observed on the two meters 128a, 130a. The meter 128a should read high and the meter 130a should read low.

Figure 5:
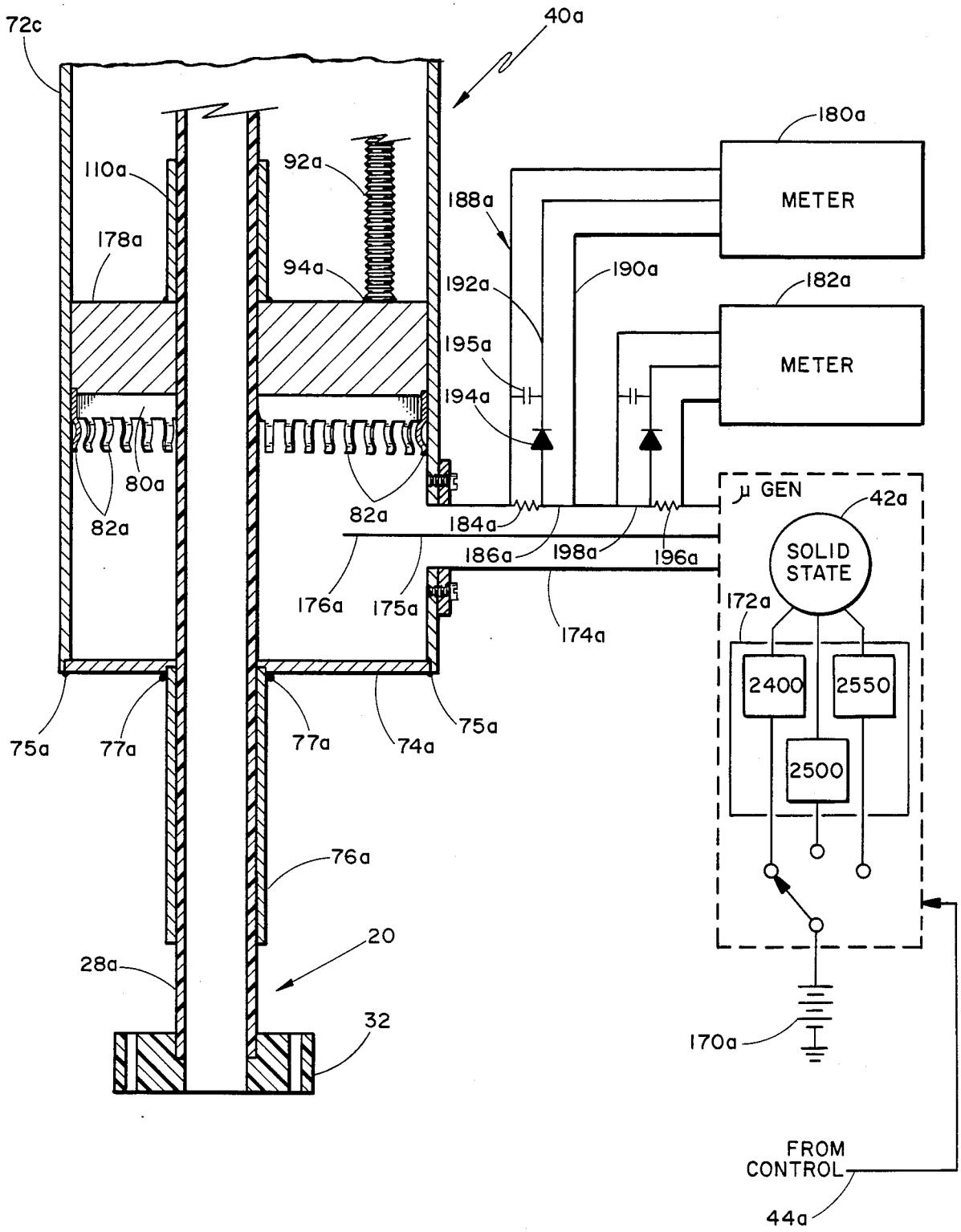
FIG. 5 is a fragmentary view generally similar to FIG. 3, the view depicting one of the monitoring cavity devices and the electronics associated therewith.

It will be well now to turn to FIG. 5 where the monitoring cavity device 40a is fragmentarily pictured. Structurally, the monitoring device 40a is identical to the device that has just been described. Because of this, only a portion of the monitoring cavity device 40a is illustrated. Although the magnitude of power supplied by the microwave generator 36a has not yet been mentioned, it will be understood that this can be on the order of 1000 watts or so. A practical range for the power would extend from, say, 500 watts up to 5,000 watts. Since the monitoring cavity device 40a is only intended to measure an electrical characteristic of the material being processed, it follows that not nearly as much power need be supplied to the monitoring device 40a as is supplied the power cavity device 34a.

Consequently, a solid state microwave generator of relatively small size is intended insofar as the generator 42a is concerned. Whereas 10 milliwatts will suffice, it is contemplated that a power range from 5 to 100 milliwatts will be used. Solid state microwave generators 42a for supplying low power, such as the 10 milliwatts are quite inexpensive, yet provide a reliable means for determining the electrical characteristic of the flowing material. All that is really needed is a low-voltage power supply, such as that labeled 170a, which can be only of the magnitude of 12.6 volts. However, inasmuch as one might very well wish to employ several different frequencies, it will be mentioned that a module 172a that can be switched so as to provide 2,400 mHz, 2,500 mHz or 2,550 mHz has been found satisfactory. By having available the three different frequencies, a complete scan of the dielectric material passing through the monitoring cavity device 40a can be accomplished.

The forward and reflected power is measured in the same fashion as with the measuring of power in the power cavity device 34a. Accordingly, coaxial cable 174a extends from the module 172a to the monitoring cavity device 40a, an exposed portion of the central conductor 175a functioning as the probe or antenna 176a for radiating microwave energy into the cavity provided by the device 42a. All that need to be understood at this time is that the piston 178a belonging to the monitoring cavity device 40a is positioned within the device 40a so as to accomodate a specific product and to provide a significant amount of reflected energy for a particular frequency, an amount sufficient to be detected readily. Since the amount of reflected energy is influenced by the absorptive capabilities of the material flowing through the monitoring cavity device 40a, the meters 180a, 182a connected in circuit therewith will indicate the amount of forward power and the amount of reflected power. This is done, once again, by means of a 50 ohm resistor 184a and a short 186a which are connected to the meter 180a via a coaxial cable 188a having an outer metallic sheath 190a and a central conductor 192a having therein a diode 194a, as well as a capacitor 195a. Reflective power is measured this way. Forward power is measured via the ammeter 182a by reversing the connections so that the 50 ohm resistor 196a is farther from the probe 176a than is the short 198a. Since the electrical characteristic is correlated with the physical condition of the material at the moment it reaches the monitoring cavity device 40a, the arrangement appearing in FIG. 5 is representative of the processing condition at that moment. Although the constructions of the microwave cavity devices 34a and 40a have been described in considerable detail, it will be understood that the power cavity devices 34b and 34c resemble the device 34a, differing in perhaps the amount of power or frequency supplied thereto. Likewise, the monitoring cavity devices 40b and 40c resemble the device 40a just described.

Figure 6:
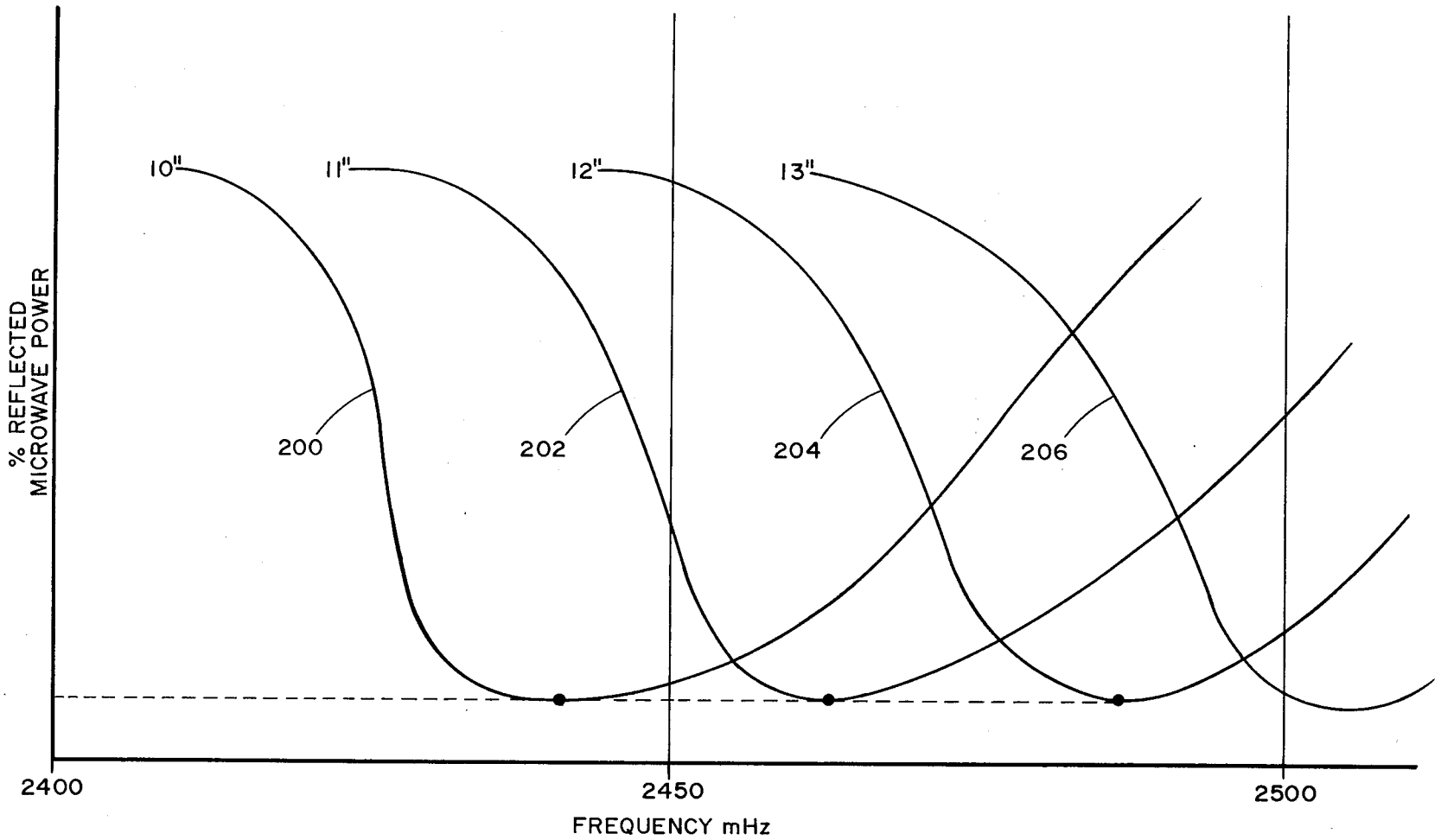
FIG. 6 constitutes a graph illustrating a series of curves utilized in interpreting data derived from one of the various monitoring cavity devices, the reflected power being plotted against frequency.

For the sake of simplicity, it will now be assumed that a granular material, such as corn, is to be dried, perhaps from approximately 20 percent moisture content down to 14 percent or so in order to assure its preservation during storage. Therefore, the microwave cavity device would supply a controlled amount of heat. FIG. 6 is intended to illustrate the adjustment of the piston 78a in the power cavity device 34a to obtain a minimum amount of reflected microwave energy. Therefore, a sequence or series of curves have been plotted in FIG. 6. It should be recognized, though, that the ordinate is plotted to show the percent of energy reflected, whereas the abscissa is plotted to show various frequencies. There are four curves: the first curve 200 has been plotted for a position of the plunger or piston 78a at a distance of 10 inches from the fixed end wall 74a, the curve 202 for a distance of 11 inches, the curve 204 for a distance of 12 inches, and the fourth curve 206 for a distance of 13 inches. It must be remembered that one is looking for a minimum amount of reflected energy when heating the material. From the graph, it is to be recognized that an optimum positioning of the piston 78a to be at 10½ inches with respect to the fixed end wall 74a for a frequency of 2,450 mHz. We have assumed that corn is the dielectric product and this would be a graph involving curves that would inform the user as to where the piston 78a should be positioned in order to provide a minimum of reflection. When one has a minimum amount of reflection, then one naturally has a maximum amount of absorption which is what is wanted as far as the power cavity device 34a is concerned. Thus, under the assumed set of conditions, one would achieve resonance at 2,450 mHz for one condition when the piston 78a is positioned at 10½ inches from the fixed end wall 74a.

Figure 7:
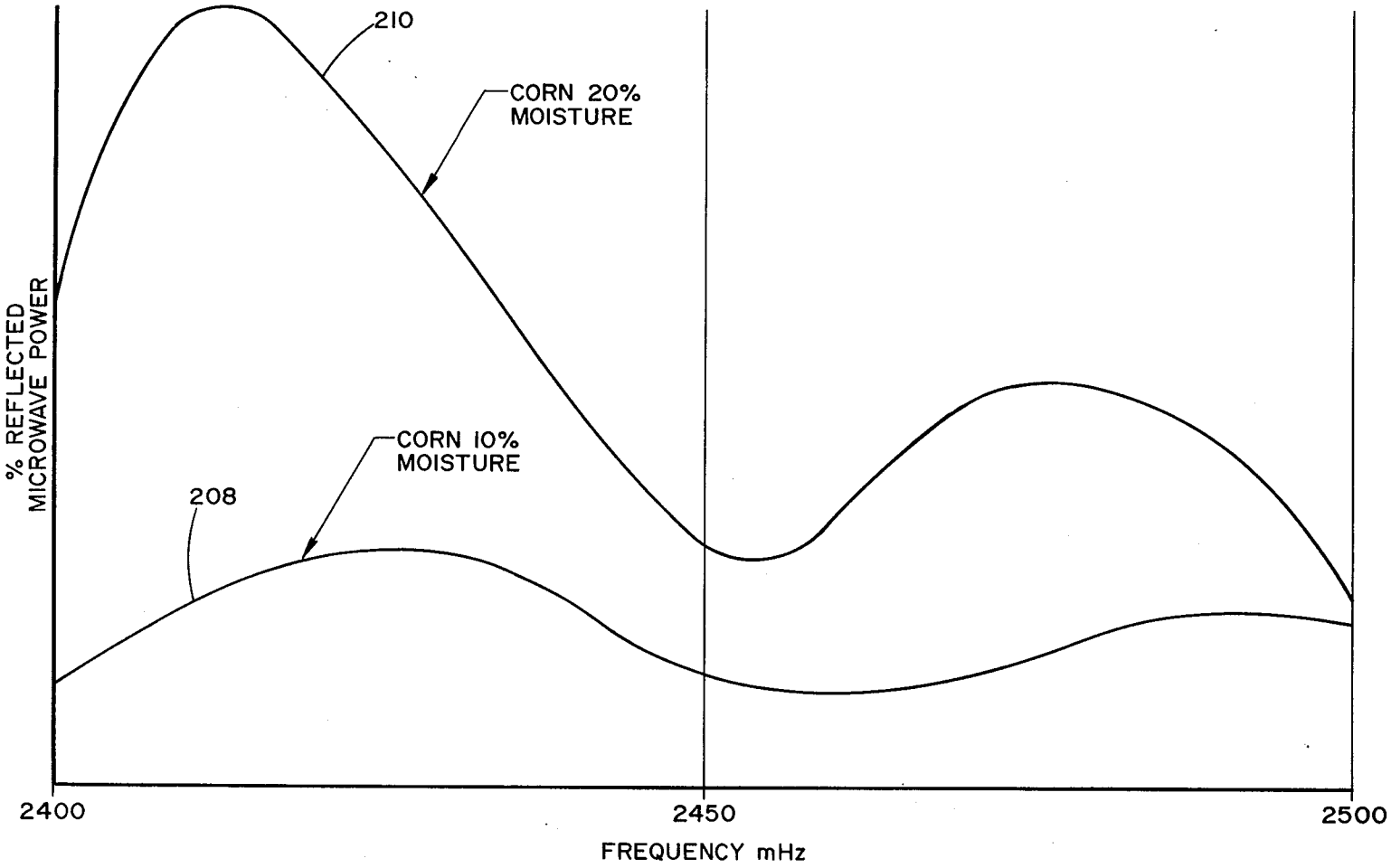
FIG. 7 is a graph similar to FIG. 6 but depicting reflected power plotted against frequency for two specific dielectric materials.

As far as the monitoring cavity device 40a is concerned, one is interested in measuring the amount of reflected power. Therefore, reference should be made at this time to FIG. 7 where curves 208 and 210 graphically depict reflected power plotted against frequency. The curve 208, in this instance, is representative of corn having a 10% moisture content and the curve 210 representative of corn having a 20% moisture content. In other words, two product conditions are exemplified in FIG. 7. It will be appreciated that the amount of moisture is correlated with the amount of reflected power. Specifically, the greatest differential in reflected power for the curve 208 occurs about 2,430 mHz, whereas the least differential appears at approximately 2,405 mHz. The greatest differential for the curve 210 results at about 2,420 mHz, while the least differential occurs at about 2,460 mHz.

From FIG. 1, it will be discerned that the several controllers 44a, 44b and 44c are responsive to the signal determined by the specific monitoring cavity device 40a, 40b or 40c with which it is associated. Thus, the microwave generators 36a, 36b and 36c can be adjusted in accordance with whatever determination is made by the corresponding monitoring cavity device 40a, 40b or 40c so as to change the amount of power delivered to the power cavity device 34a, 34b or 34c. For instance, the power cavity device 34b might very well be operated around 5,000 watts, this being desirable if, say, corn possesses a moisture content on the order of 20 percent. The power cavity device 34b, however, might be operated around 3,000 watts, whereas the third power cavity device 34c might very well be operated in the vicinity of 1,000 watts. On the other hand, a particular product condition might make it desirable to have the power cavity device 34a operate at 915 mHz, the power device 34b at 2,450 mHz, and the power device 34c at 5,000 mHz. The foregoing frequencies are only illustrative, and should not be construed to represent a practical application of the invention. The point to be emphasized, however, is that considerable versatility and flexibility are incorporated into the apparatus 10 so as to cope with various conditions, both with respect to a given product and also with respect to various products.

Consequently, assuming that the power cavity device 34a is to operate around 5,000 watts and that the power should be increased somewhat in order to more effectively remove moisture, then the controller 44a, because of the monitoring device 40a sensing an electrical characteristic representative of an "excessive" level or degree of moisture, would simply increase the power supplied by the microwave generator 36a. It will be understood that the controller 44a, as well as the controllers 44b and 44c, can assume various forms, being either an analog or digital type.

The present invention also will find especial utility in the processing of, say potato chips. Potato chips are quite fragile and yet should possess a minimum amount of moisture therein. Owing to the fact that potato chips vary widely with respect to their irregularity of shape, it is indeed difficult to ascertain the moisture content thereof without crushing them. At least, prior art techniques have required that a percentage of the potato chips be crushed and then subjected to infrared energy so that the amount of moisture can be measured. Of course, if one is running a potato chip line and the line must be shut down in order to make a change in the amount of drying that is being provided, then this is quite a costly operation. Hence, it should be obvious that a system in which the chips need not be crushed would be highly advantageous. In the apparatus 10, potato chips can be satisfactorily processed, using a non-auger feeder, and it should be observed that each of the three units or stages 18a, 18b and 18c would indicate the amount of drying that has occurred at the discharge end of that station. By the time the potato chips reach the storage bin 22 at the bottom of the apparatus 10, the drying has been progressively achieved by the amount of microwave directed into each of the various power cavity devices 34a, 34b and 34c, the cummulative effect producing a desired overall result. In this situation the apparatus 10, especially the conduit means 20, would be dimensioned so as to accommodate the larger size product (potato chips).

Recapitulating, the versatility of the apparatus 10 is demonstrated by assuming, as an example, that the first unit or stage 18a effects a given amount of drying which is measured by the monitoring cavity device 40a with the power cavity device 34a being adjusted accordingly by the controller 44a to provide an optimum amount of drying. However, one may wish to add one or more ingredients at the second unit or stage 18b, doing so through the agency of the nutrient supply 52. Somewhat similarly, a sugar coating might very well be desired toward the end of the overall process, so the sweetener supply 54 would perform this task.

Figure 4:
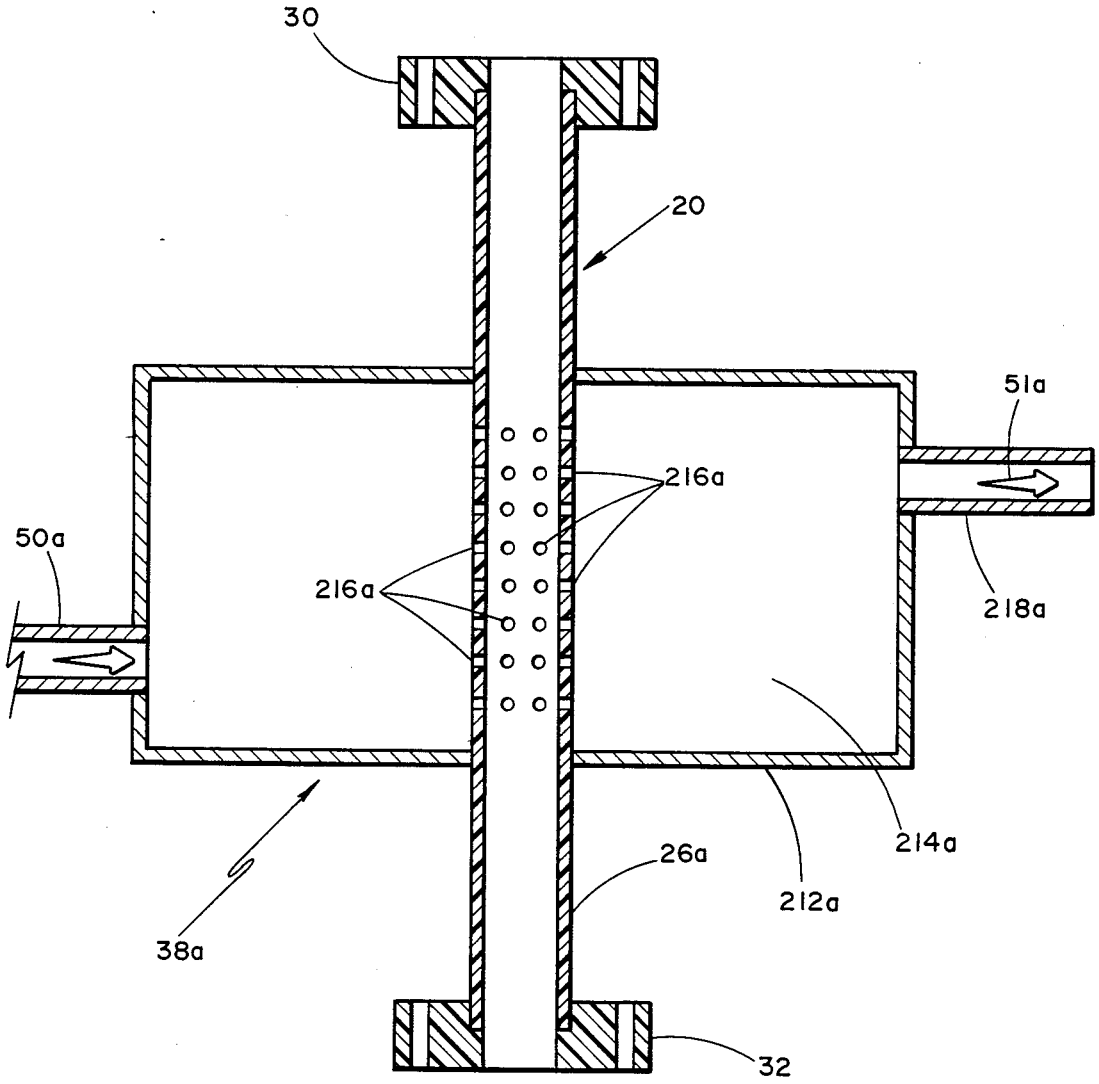
FIG. 4 is a vertical sectional view through one of the vapor removing units.

Inasmuch as the invention will find considerable utility in the drying of granular products, the air supply system 46 has been generally described. The detailed description of the vapor removing chambers 38a, 38b and 38c or has been deferred up to this particular point. Therefore, at this time attention is directed to FIG. 4 wherein the vapor removing chamber 38a includes a housing 212a forming a plenum 214a. The branch line 50a appearing in FIG. 1 has been fragmentarily shown in FIG. 4. It enters the lower portion of the chamber 38a and the air so introduced is directed radially inwardly toward the centrally disposed plastic tube 26a. The plastic tube 26a in this instance has a number of holes or perforations 216a therein so that some of the air forced through the branch line 50a will pass through the plastic tube 26a. Whatever moisture entrained in the vapor will in this way be forced outwardly toward the other side of the plenum 214a, exiting via a pipe 218a adjacent the upper side of the housing 212a. Not only will the size of the perforations prevent the blowing out of the material passing downwardly through the plastic tube 26a (which is but a longitudinal portion of the overall conduit means 20), but a baffling effect is provided by having the discharge pipe 218a located at an elevation above the entering pipe which constitutes the branch line 50a in the pneumatic system 46. Obviously, more practical equipment would be employed, the specific equipment depending to a great extent on the type of installation.

Although three vapor removing chambers 38a, 38b and 38c have been shown, one for each of the units or stages 18a,18b and 18c, it will be recognized that in some installations only one such unit will be needed. On the other hand, depending upon the type of material being processed, there are occasions when no vapor removing chamber 18, 18b or 18c will be required. For instance, if only a heating or curing of a material that does not contain any substantial amount of moisture therein is to be processed, then there is no need to remove any moisture from the product or material. Possibly only a chemical additive might be introduced at times and this would be done, say, through the agency of the nutrient supply labeled 52 or perhaps in lieu of the sweetener supply labeled 54.

What should be appreciated from the foregoing description is that a variety of substances can be adequately processed when utilizing the teachings of this invention. The apparatus 10 can comprise a number of components best suited for the type of materials known to require processing with provision for those materials that might at some future time be expected to require processing. Consequently, at times certain components comprising the apparatus 10 will be made use of and at other times such components will not be made use of.

The apparatus 10 and associated method afford the user the opportunity to choose what components are best suited to optimize the particular process being conducted. What should be appreciated, though, is that the serially connected plastic tubes 24, 26 and 28 collectively constitute continuous dielectric conduit means 20 that extends from the top of the apparatus 10 to the bottom thereof.

What is claimed:

1. Microwave apparatus comprising a plurality of vertically oriented and tandemly arranged cavity devices, means for individually tuning each of said cavity devices, dielectric conduit means extending through each of said cavity devices, respective means for supplying microwave power to each of said cavity devices, respective means for varying the amount of microwave power supplied to each of said cavity devices and including means for determining the amount of power being supplied to each of said cavity devices, respective means for determining the amount of power reflected from each of said cavity devices, and respective monitoring means for each of said cavity devices for determining an electrical characteristic of a material passing through said dielectric conduit means, each of said monitoring means constituting a tunable cavity device including a shiftable piston, said dielectric conduit means also extending through the piston of each of said monitoring cavity devices.

2. Microwave apparatus comprising a tunable cavity device including an elongated casing, a fixed wall adjacent one end of said casing, a wall within said casing movable with respect to said fixed wall, dielectric conduit means passing through both of said walls in a spaced relation with said casing, and means for introducing microwave power into the space between said conduit means and said walls.

3. Microwave apparatus in accordance with claim 2 in which said casing and said conduit means are both cylindrical.

4. Microwave apparatus in accordance with claim 3 in which said conduit means is offset within said casing.

5. Microwave apparpatus in accordance with claim 4 in which said power introducing means includes an antenna projecting into the space between said casing and said conduit means at a location where the spacing between said casing and said conduit means is greater due to the offsetting of said conduit means within said casing.

6. Microwave apparatus in accordance with claim 5 including a microwave generator for supplying microwave power to said antenna.

7. Microwave apparatus in accordance with claim 6 including means associated with said antenna for determining the amount of microwave power being supplied to said cavity device.

8. Microwave apparatus in accordance with claim 7 including means associated with said antenna for determining the amount of power being reflected from said cavity device.

9. Microwave apparatus in accordance with claim 2 in which said conduit means includes a cylindrical plastic tube having a length greater than the length of said casing.

10. Microwave apparatus in accordance with claim 9 in which said movable wall constitutes a shiftable piston, and including means for shifting said piston within said casing.

11. Microwave apparatus in accordance with claim 2 in which said cavity device is vertical and said dielectric conduit means extends vertically downwardly and completely through said cavity device, so that dielectric material entering the upper end of said conduit means will flow gravitationally downwardly through the entire length of said conduit means and downwardly and entirely through said cavity device.

12. Microwave apparatus in accordance with claim 2 in which said means for introducing microwave power introduces power into said space at a location spaced approximately equally from each of said walls.

13. Microwave apparatus in accordance with claim 12 in which said means for introducing power includes an antenna projecting into said space at said location spaced approximately equally from each of said walls.

14. Microwave apparatus in accordance with claim 13 in which said casing is cylindrical and said conduit means is offset within said casing, said antenna extending through said casing into said space where the space between said casing and said conduit means is increased by the offsetting of said conduit means.

15. Microwave apparatus comprising a series of vertically arranged devices, each device having a vertically oriented tunable cavity, dielectric conduit means extending downwardly through each of said cavity devices, respective means for supplying microwave power to each of said cavity devices at substantially the vertical center of the cavity with which the particular power supplying means is associated, the uppermost power supplying means providing the greatest amount of power and the lowermost power supplying means supplying the least amount of power.

16. Microwave apparatus in accordance with claim 15 in which the means supplying the greatest amount of power supplies the power at a lesser frequency than the other power supplying means and the power supplying means supplying the least amount of power supplies such a power at the highest frequency.

17. Microwave apparatus in accordance with claim 16 in which each of said cavity devices includes a movable piston therein for tuning the cavity with which it is associated.

18. Microwave apparatus comprising a plurality of tunable cavity devices, means for supplying microwave power to each of said cavity devices, conduit means of a dielectric character extending through said plurality of cavity devices, each cavity device having a movable piston therein and means for positioning at least one of said pistons so as to maximize forward power, and means for positioning at least another of said piston so as to maximize reflected power.

19. Microwave apparatus in accordance with claim 18 including means for measuring the amount of forward power, and means for measuring the amount of reflected power.

20. Microwave apparatus in accordance with claim 19 including first means for supplying microwave energy to the cavity having the piston therein that achieves maximum forward power, said supplying means supplying power on the order of 1,000 watts, and second means for supplying microwave to the cavity device in which the position of the piston maximizes reflected power, said second supplying means supplying power on the order of 10 milliwatts.

21. Microwave apparatus comprising a plurality of vertically oriented and tandemly arranged cavity devices, means for individually tuning each of said cavity devices, dielectric conduit means extending through each of said cavity devices, respective means for supplying microwave power to each of said cavity devices, respective means for varying the amount of microwave power supplied to each of said cavity devices and including means for determining the amount of power being supplied to each of said cavity devices, respective means for determining the amount of power reflected from each of said cavity devices, and respective monitoring means for each of said cavity devices for determining an electrical characteristic of a material passing through said dielectric conduit means, each of said monitoring means constituting a tunable cavity device including a shiftable piston, said dielectric conduit means also extending through the piston of each of said monitoring cavity device, each of said cavity devices including a shiftable piston through which said dielectric conduit means extends and including respective means for individually positioning each of said pistons to tune each of said cavity devices.

22. Microwave apparatus in accordance with claim 21 in which said monitoring means includes an additional tunable cavity device, said additional cavity device encircling said conduit means near the discharge or exit side of one of said tandemly arranged cavity devices and each of said additional tunable cavity devices including a shiftable piston through which said conduit means extends.

23. Microwave apparatus in accordance with claim 22 including means for determining the amount of power reflected from said additional cavity device.

24. Microwave apparatus comprising a power cavity device having a movable piston, a monitoring cavity device connected beneath said power cavity device and in tandem to said power cavity device, said monitoring cavity device also having a movable piston, first means for supplying microwave power to said power cavity device, second means for supplying microwave power to said monitoring cavity device, means responsive to the amount of forward power to said monitoring cavity device for indicating the piston position to maximize the amount of power to said power cavity device and to minimize the amount of reflected power from said power cavity device.

25. Microwave apparatus in accordance with claim 24 including means responsive to the amount of reflected power from said monitoring device for indicating the proper position of the piston of said monitoring cavity device to maximize the amount of reflected power from said monitoring device and to minimize the amount of forward power to said monitoring cavity device.

26. Microwave apparatus in accordance with claim 25 in which the amount of microwave power delivered to said power device is on the order of 1,000 watts.

27. Microwave apparatus in accordance with claim 26 in which the amount of microwave power delivered to said monitoring device is on the order of 10 milliwatts.

28. Microwave apparatus in accordance with claim 27 in which the frequency of the power delivered to said power and monitoring devices is on the order of 2,450 mHz.

29. A microwave method comprising the steps of causing a material to flow downwardly through a vertical dielectric conduit means extending completely through a first casing having upper and lower walls, subjecting the entire portion of said conduit means residing between said end walls to microwave power, said microwave power being introduced at a first location spaced from both of said walls, determining the amount of reflected microwave power at said first location, and adjusting the amount of microwave power to which said conduit means is subjected to maximize the amount of power adsorption by said material at said first location.

30. A method in accordance with claim 29 in which said dielectric conduit means also extends vertically through a second casing having upper and lower end walls and including the steps of subjecting said conduit means to microwave power at a second location longitudinally spaced from said first location and spaced from both of the end walls of said second casing, determining the amount of reflected microwave power at said second location, and adjusting the amount of microwave power at said second location to maximize the amount of power reflected by said material at said second location.

31. A method in accordance with claim 30 in which the microwave power to which the entire portion of said dielectric conduit means within said first casing is subjected propagates upwardly and downwardly from said first location and the amount of microwave power to which said conduit means is subjected within said first casing is on the order of 1,000 watts, and the microwave power to which the entire portion of said dielectric conduit means within said second casing is subjected propagates upwardly and downwardly from said second location and the amount of microowave power to which said conduit means is subjected within said second casing is on the order of 100 milliwatts.

32. A method in accordance with claim 31 in which the amount of microwave power to which said conduit means within said first casing is subjected is between 500 and 5,000 watts, and the amount of microwave power to which said conduit means is subjed within said second casing is between 5 and 100 milliwatts.

33. The method of processing a dielectric material comprising the steps of passing such a material through a movable piston which is a component of a tunable cavity device, and supplying microwave power to said tunable cavity device while said material is passing through said movable piston.

34. A method in accordance with claim 33 in which there are a plurality of vertically spaced cavity devices, each having a movable piston therein, and conduit means extending downwardly through each of said cavity devices, the method including the step of feeding the material to be processed into the upper end of said conduit means so that it flows gravitationally downwardly through said conduit means and through each of said tunable cavity devices, and supplying microwave power to each of said cavity devices.

35. A method in accordance with claim 34 including the steps of supplying microwave power to each of said cavity devices and simultaneously adjusting the amount of power being supplied to each of said cavity devices.

36. A method in accordance with claim 35 in which the amount of power supplied depends upon an electrical characteristic of the material passing through said conduit means.

37. A method in accordance with claim 36 in which at least one of said cavity devices heats the material passing therethrough and at least another of said cavity devices determines said electrical characteristic.

38. A method in accordance with claim 37 including the step of measuring the amount of reflected power from the cavity device that determines said electrical characteristic.

39. Microwave apparatus comprising first and second vertically disposed power cavity devices, means for causing a material to be processed to pass downwardly through each of said devices, means for introducing microwave power into said first device so that microwave energy propagates upwardly and downwardly through the material passing through said first power cavity device, means for individually tuning said first device, means for introducing microwave power into said second device so that microwave energy propagates upwardly and downwardly through the material passing through said second power cavity device, and means for individually tuning said second device.

40. Microwave apparatus in accordance with claim 39 in which each of said devices includes a casing having upper and lower walls forming a cavity therebetween, and each of said means for introducing microwave power into said device includes an antenna extending into its particular cavity at a location spaced substantially equally from the upper and lower walls of the device with which the antenna is associated.

41. Microwave apparatus in accordance with claim 40 in which one of said walls of each device is movable.

42. Microwave apparatus in accordance with claim 41 in which said material enters through the upper wall of each of said devices and exits through the lower wall thereof.

43. Microwave apparatus comprising a tunable cavity device including an elongated casing, a dielectric conduit extending entirely through said elongated casing and having end portions projecting from ends of said casing, said dielectric conduit being spaced from the inner surface of said casing throughout the length thereof, said casing including spaced walls extending transversely across said casing, one of which walls is movable, said dielectric conduit passing through both of said walls, a flange on each of said projecting ends to render said cavity device modular, and means for introducing microwave power into said cavity device.

* * * * *